US010568394B2

(12) United States Patent
Eynav

(10) Patent No.: US 10,568,394 B2
(45) Date of Patent: Feb. 25, 2020

(54) ATTACHMENT DEVICE AND METHOD OF FABRICATING AN ATTACHMENT DEVICE

(71) Applicant: Shai Eynav, Lansing, NY (US)

(72) Inventor: Shai Eynav, Lansing, NY (US)

( * ) Notice: Subject to any disclaimer, the term of this patent is extended or adjusted under 35 U.S.C. 154(b) by 0 days.

(21) Appl. No.: 15/795,407

(22) Filed: Oct. 27, 2017

(65) Prior Publication Data

US 2019/0125038 A1 May 2, 2019

(51) Int. Cl.
*A44B 13/00* (2006.01)
*A44B 18/00* (2006.01)
*A44B 99/00* (2010.01)

(52) U.S. Cl.
CPC ..... *A44B 13/0029* (2013.01); *A44B 18/0073* (2013.01); *A44B 99/00* (2013.01)

(58) Field of Classification Search
CPC .. A44B 13/0029; A44B 18/0073; A44B 19/60
See application file for complete search history.

(56) References Cited

U.S. PATENT DOCUMENTS 1,429,259 A * 9/1922 Tagliaferry ..... A43C 15/063 36/62
4,569,348 A * 2/1986 Hasslinger ..... A61M 25/02 128/DIG. 15
5,131,151 A * 7/1992 Agase ..... A47G 21/02 224/220
5,201,447 A * 4/1993 Bumb ..... F41C 33/0227 224/243
5,215,238 A * 6/1993 Baruch ..... F41A 17/54 224/243
5,311,972 A * 5/1994 Plath ..... A45C 3/004 190/102
5,676,642 A * 10/1997 Peters ..... A61F 5/0127 602/23
5,737,856 A 4/1998 Brockman
5,842,584 A 12/1998 Baird
6,138,882 A * 10/2000 Buettner ..... A45C 13/00 190/102
7,096,544 B2 8/2006 Lusardi
7,621,396 B1 * 11/2009 Flores ..... B25F 5/029 206/379
9,526,832 B1 * 12/2016 Barnard ..... A61M 5/172
9,622,560 B2 4/2017 Papas
10,080,423 B1 * 9/2018 Bandlow ..... A45C 13/30

* cited by examiner

*Primary Examiner* — Robert Sandy
*Assistant Examiner* — David M Upchruch
(74) *Attorney, Agent, or Firm* — Donald J. Lecher

(57) ABSTRACT

An attachment device includes a webbing matrix having an elastic property in at least one direction, and a gripping member fixedly connected to a first distal end the webbing matrix. The device further includes a first hook or loop material disposed proximate a second distal end and on a first side of the webbing matrix, and on a second corresponding hook or loop material disposed proximate the first distal end and on a second side of the webbing matrix. The device further includes a series of gripping elements being infused into the second side of the webbing matrix, and a fastening device disposed on the first side of the webbing matrix, where the fastening device includes a thin flexible base material surrounding a perimeter of the fastening device, the thin flexible base material fixedly connected to the webbing matrix.

21 Claims, 8 Drawing Sheets

ATTACHMENT DEVICE AND METHOD OF FABRICATING AN ATTACHMENT DEVICE

BACKGROUND

This disclosure relates to an attachment device that may be fixedly secured to a portable object such that a fastening device protruding from an outer portion of the attachment device may then be connected to an external holding device to securely retain the portable object thereupon.

SUMMARY

It should be appreciated that this Summary is provided to introduce a selection of concepts in a simplified form that are further described below in the Detailed Description. This Summary is not intended to be used to limit the scope of the claimed subject matter.

In one embodiment disclosed herein, an attachment device includes a webbing matrix having an elastic property in at least one direction, and a gripping member fixedly connected to a first distal end the webbing matrix. The device further includes a first hook or loop material disposed proximate a second distal end and on a first side of the webbing matrix, and on a second corresponding hook or loop material disposed proximate the first distal end and on a second side of the webbing matrix. The device further includes a series of gripping elements being infused into the second side of the webbing matrix, and a fastening device disposed on the first side of the webbing matrix. The fastening device further includes a thin flexible base material surrounding a perimeter of the fastening device, the thin flexible base material being fixedly connected to the webbing matrix.

In another embodiment disclosed herein, an attachment device includes a webbing matrix, and a gripping member fixedly connected by an elastic member to a first distal end the webbing matrix. A first hook or loop material is disposed proximate a second distal end and on a first side of the webbing matrix, and a second corresponding hook or loop material is disposed proximate the first distal end and on a second side of the webbing matrix and gripping member. The device further includes a series of gripping elements infused into the second side of the webbing matrix, and a fastening device disposed on the first side of the webbing matrix, where the fastening device further includes a thin flexible base material surrounding a perimeter of the fastening device, the thin flexible base material being fixedly connected to the webbing matrix.

In another embodiment disclosed herein, a method of manufacturing an attachment device includes providing a webbing matrix having an elastic property in at least one direction, fixedly connecting a gripping tab to a first distal end the webbing matrix, and fixedly connecting a first hook or loop material proximate a second distal end and on a first side of the webbing matrix. The method further includes fixedly connecting a second corresponding hook or loop material to a second region of the webbing matrix at the first distal end and on a second side of the webbing matrix, and infusing a series of gripping elements into the second side of the webbing matrix. Furthermore, the method includes fixedly attaching a thin flexible base material supporting a fastening device to the webbing matrix within the first region defined by the first hook or loop material on the webbing matrix.

BRIEF DESCRIPTION OF THE SEVERAL VIEWS OF THE DRAWINGS

The embodiments of the invention will be better understood from the following detailed description with reference to the drawings, which are not necessarily drawing to scale and in which.

DETAILED DESCRIPTION

Figure 1A:
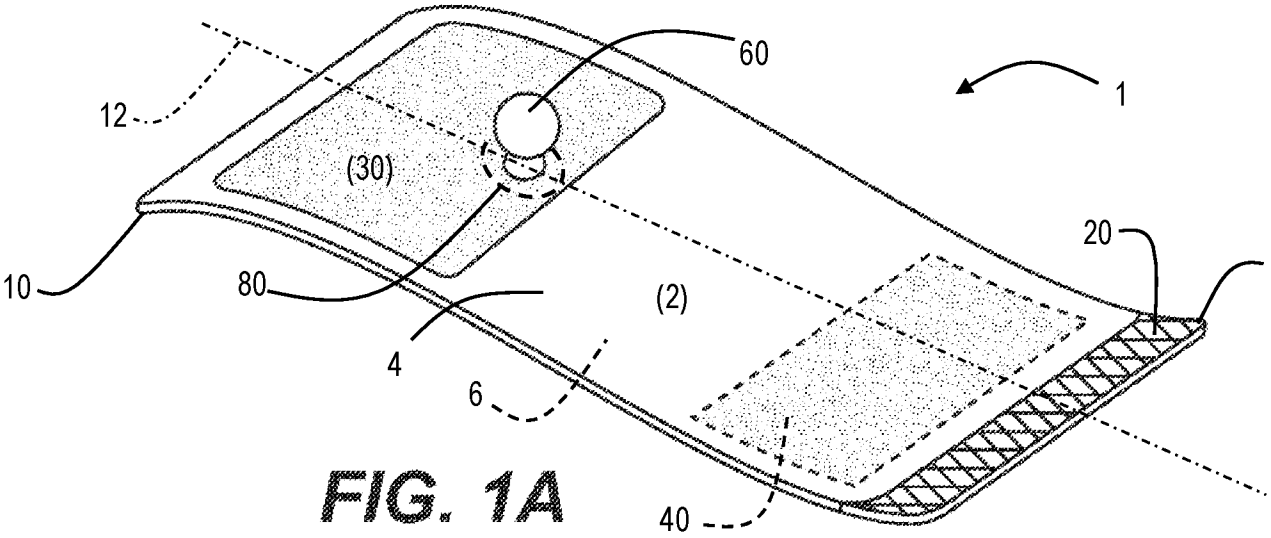
FIG. 1A illustrates a top perspective view of a first embodiment of an attachment device.
Figure 1B:
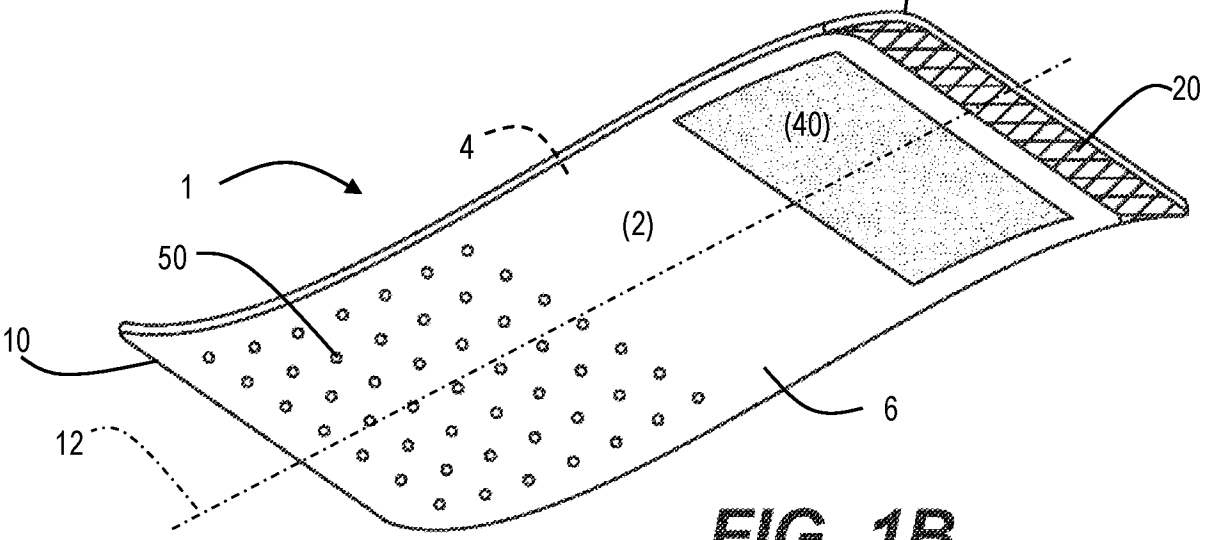
FIG. 1B illustrates a bottom perspective view of the first embodiment of the attachment device.

FIG. 1A illustrates a top perspective view and FIG. 1B a bottom perspective view of a first embodiment of the attachment device (1). The attachment device (1) is composed of a flexible webbing (2) having a first side (4), a second side (6), and a first end (8) and on a second end (10). The flexible webbing (2) may have elastic property limited to only a single or unilateral direction, or it may allow stretching in a multilateral direction. For example, the flexible webbing (2) may allow elastic stretching only along a longitudinal axis (12) of the flexible webbing (2) that follows the webbing longitudinal length (14), (see FIG. 2), or it may additionally allow elastic stretching along the direction defined by the webbing width (16) (See FIG. 2).

A grip tab (20) may be connected that the first end (8) of the flexible webbing (2) on either the first side (4) or the second side (6), or the grip tab (20) may be connected at a distal end portion of the first end (8) of the flexible webbing (2). The grip tab (20) may be connected to the flexible webbing (2) by means of stitching, adhesive and/or any suitable means or combination of means thereof.

A first hook or loop material (30) is disposed on the first side (4) and proximate the second end (10) of the flexible webbing (2). A second corresponding hook or loop material (40) is disposed on the second side (6) and proximate to the first end (8) of the flexible webbing (2). Both the first hook or loop material (30) and the second corresponding hook or loop material (40) may be connected to the flexible webbing (2) by means of stitching (80), adhesive and/or any suitable means or combination of means thereof.

A gripping element pattern (50) may be disposed on the second side (6) and between the second end (10) and a center portion of the flexible webbing (2). The gripping element pattern (50) may include a pattern of silicon infused into the surface of the flexible webbing (2). For illustrative purposes, FIGS. 1A and 1B depict an array of silicon dots or bumps (50) infused into the flexible webbing (2). Other patterns, discussed later herein, are provided to allow the attachment device (1) to be securely wrapped around an object without slipping, rotating or twisting when secured upon an object.

FIGS. 1A and 1B further illustrate a first fastening device embodiment of a fastening device pin (60). The fastening device pin (60) may be located on the first side (4) of the flexible webbing (2). In the first fastening device embodiment, the fastening device pin (60) includes a thin flexible base flange (62), (see FIG. 5A), located proximate a base perimeter portion (64) of the fastening device pin (60). From the base perimeter portion (64), a neck section (66) protrudes away from the flexible webbing (2) and is joined to a larger diameter head section (68) defining a distal end (70) of the fastening device pin (60) opposite the flexible webbing (2). The head section (68) further includes a spherical portion (72) that is configured to engage and be retained within portable equipment retention devices later described herein. The thin flexible base flange (62) may be positioned and affixed on either the first side (4) or the second side (6) (via a corresponding aperture, not shown), of the flexible webbing (2) by stitching (80), adhesive and/or any suitable means or combination of means thereof. One advantage of stitching (80) that connects the thin flexible base flange (62), is that the stitching (80) allows the thin flexible base flange (62) to more freely move with any movement of the elastic underlying flexible webbing (2).

Figure 2:
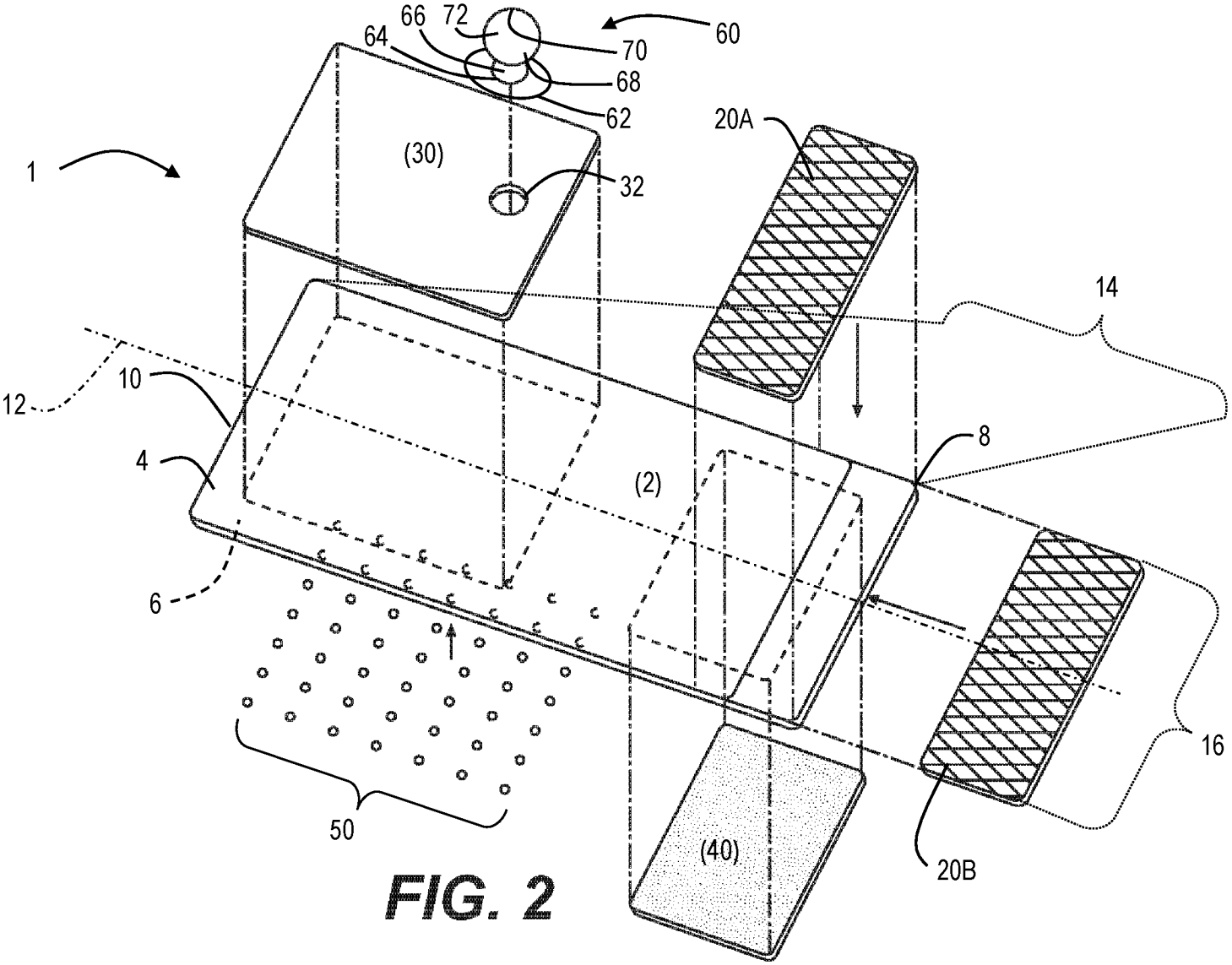
FIG. 2 illustrates a perspective assembly view of the first embodiment of the attachment device.

FIG. 2 illustrates a perspective assembly view of the first embodiment of the attachment device. To fabricate the attachment device (1), a webbing matrix (2) having an elastic property in at least one direction is provided. A grip tab (20A, 20B) is fixedly connecting to a first distal end (8) the webbing matrix (2). FIG. 2 illustrates a variety of alternative embodiments to accomplish this: either the grip tab (20A) is placed directly over a portion the webbing matrix (2) on the first end (8); the grip tab (20B) may be attached to an end portion of the webbing matrix (2); or the grip tab (20) may be placed anywhere between these two described placements having a portion of the grip tab (20) on the webbing matrix (2) and a portion being free from the webbing matrix (2).

A first hook or loop material (30) may be fixedly connecting proximate a second distal end (10) and on a first side (4) of the webbing matrix (2). First hook or loop material (30) may additionally provide a hole (32) configured to receive a neck section (66) of the pin (60) such that the flexible flange (62) may be disposed between the first hook or loop material (30) and the first side (4) of the webbing matrix (2). A second corresponding hook or loop material (40) may be fixedly connecting to the first end (8) and on a second side (6) of the webbing matrix (2). The first hook or loop material (30) on the first side (4) is designed to be removably connected to the second corresponding hook or loop material (40) on the second side (6) of the webbing matrix (2) when the attachment device is wrapped upon itself, (see FIG. 4).

A series of gripping elements (50) may be infused into the second side (6) of the webbing matrix (2) between the second end (10) and proximate a mid-point of the attachment device (1). These gripping elements (50) may consist of any rubberized or silicone-based compound that may be infused into the webbing matrix (2) when the material is in a flowable or non-hardened state. FIG. 2 illustrates the gripping elements (50) as an array of horizontal and vertical arrayed dots or bumps. Other patterns are discussed with respect to FIGS. 3A and 3B, below. The series of gripping elements (50) may include infusing an array of uniformly spaced elements disposed across a portion of the length (14) and the width (16) of webbing matrix opposite the first hook or loop material (30). The gripping elements (50) may include a pattern of lines disposed across a portion of the length and the width of webbing matrix (2). The series of gripping elements (50) may be disposed into the second side (6) of the webbing matrix (2) opposite the first hook or loop material (30). The purpose of these gripping elements is to provide a gripping resistance on an attached object by preventing the attachment device (1) from slipping, sliding or otherwise rotating.

A thin flexible base flange (62), (see FIG. 5A), supporting a fastening device (60) may be fixedly attached on the webbing matrix (2) proximate the first hook or loop material (30) on the first side (4) of the webbing matrix (2). In one embodiment, the thin flexible base flange (62) may be stitched to the webbing matrix (2) and/or the first hook or loop material (30).

FIGS. 3A to 3D illustrate top and bottom views of various embodiments of the attachment device. Reference numbers for similar previously discussed elements are carried throughout these figures for consistency purposes. Each of the following described features may be used independently of other described features or may be combined with any other describe feature.

Figure 3A:
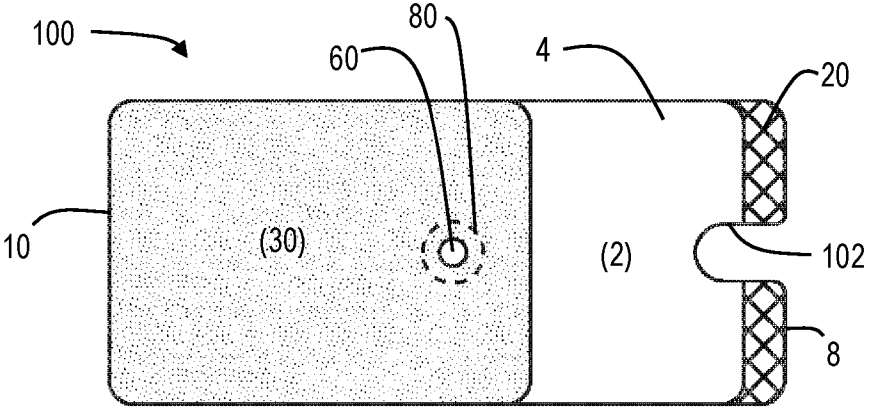
FIG. 3A illustrates a top view of the second embodiment of an attachment device.
Figure 3B:
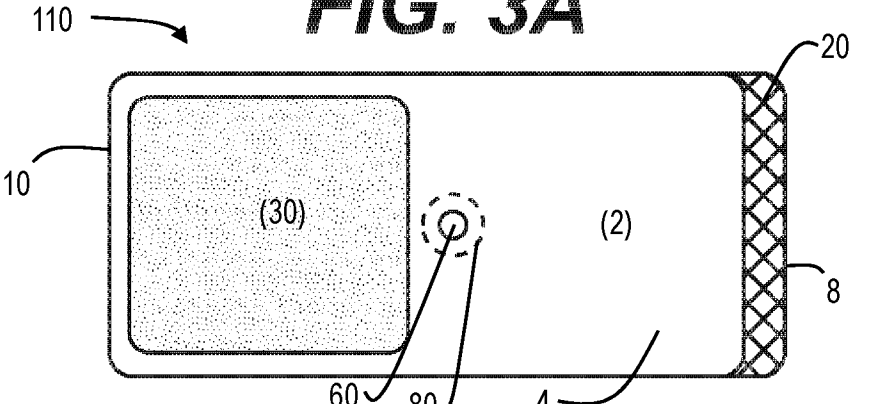
FIG. 3B illustrates a top view of a third embodiment of an attachment device.

FIG. 3A illustrates a top view of the second embodiment of an attachment device (100) that includes recessed portion (102) in the grip tab (20) and/or the webbing matrix (2). The recessed portion (102) enables the first end (4) of the attachment device (1) to move beyond the fastening device (60) when the first end (4) is wrapped around the second end (6) and the fastening device (60) is disposed within the recessed portion (102) to further enable this second embodiment to be attached to thinner objects. FIG. 3A additionally illustrates the first hook or loop material (30) extending around the fastening device (60). FIG. 3B illustrates a top view of a third embodiment of an attachment device (110) where the first hook or loop material (30) does not extend around the fastening device (60).

Figure 3C:
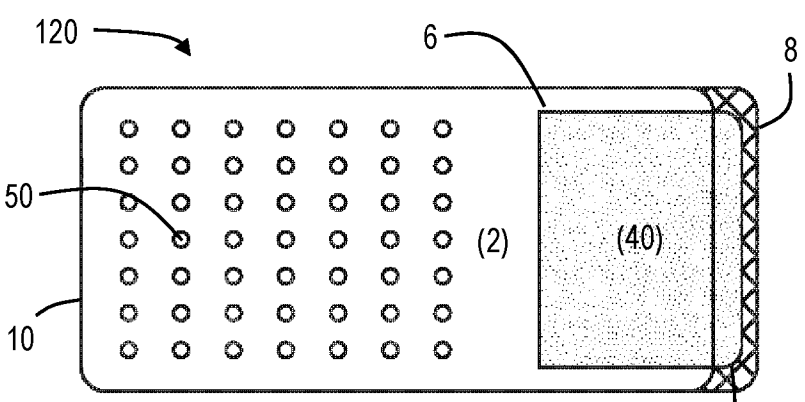
FIG. 3C illustrates a bottom view of fourth embodiment of an attachment device.
Figure 3D:
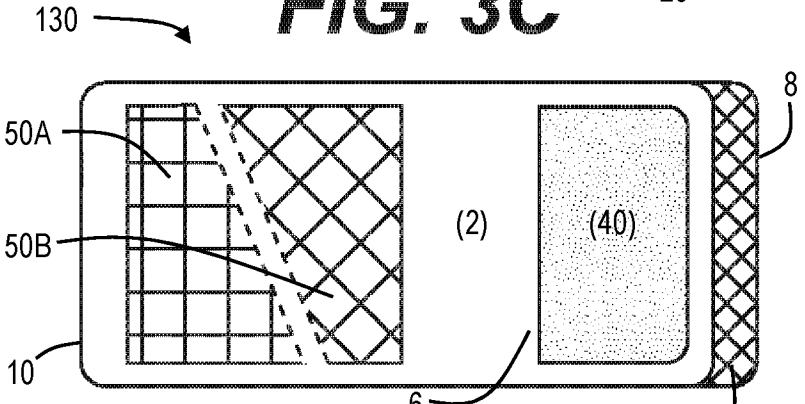
FIG. 3D illustrates the bottom view of a fifth embodiment of an attachment device.

FIG. 3C illustrates a bottom view of fourth embodiment of an attachment device (120) includes a gripping element pattern (50) of dots or bumps disposed in an array. FIG. 3C further illustrates a second corresponding hook or loop material (40A) disposed upon the webbing matrix (2) and the grip tab (20). FIG. 3D illustrates a bottom view of a fifth embodiment of an attachment device (130) includes a gripping element pattern (50A) include in a horizontal and vertical line pattern aligned with and orthogonal to the longitudinal axis (12) of the attachment device (1). An additional alternative gripping element pattern (50B) is illustrated that includes a diamond-like pattern disposed at an angle to the longitudinal axis (12) of the attachment device (1). FIG. 3D further illustrates a second corresponding hook or loop material (40B) disposed only on the webbing matrix (2) and not on the grip tab (20).

Figure 4:
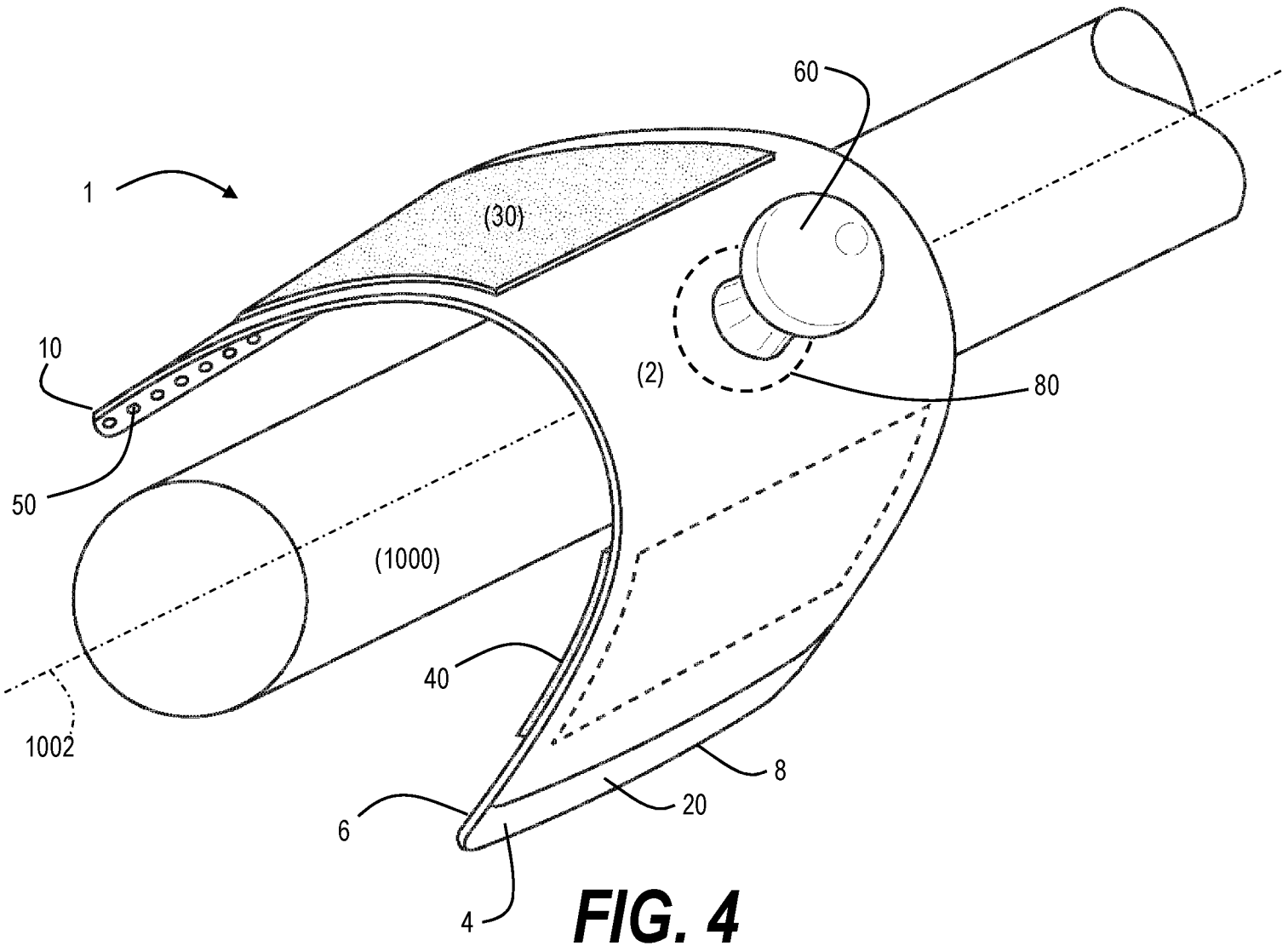
FIG. 4 illustrates a perspective view of the first embodiment of the attachment device preparing to be placed on an object.

FIG. 4 illustrates a perspective view of the first embodiment of the attachment device (1) preparing to be placed on a structural member (1000) in a direction around the structural member longitudinal axis (1002). First, the second end (6) is oriented with respect to the structural member (1000) such that the gripping element pattern (50) may contact a surface of the structural member (1000). Secondly, the first end (8) is wrapped around these structural member (1000) and above the first side (4) of the second end (10) such that the second corresponding hook or loop material (40) contacts and is fastened to the first hook or loop material (30). The gripping element pattern (50) contacting the structural member (1000) prevents the attachment device (1) from sliding in a direction A along the structural element (1000), from slipping in a direction B around the structural element (1000), and from rotating C upon the structural element (1000).

FIGS. 5A to 5E illustrate partial perspective views of alternate fastening devices mounted on the webbing matrix (2) of the attachment device (1) depicted in FIGS. 1A to 4. Note that each of the alternate fastening devices described below may be disposed within the first hook or loop material (30), (as illustrated in FIG. 3A), or outside of the first hook or loop material (30), (as illustrated in FIG. 3B).

Figure 5A:
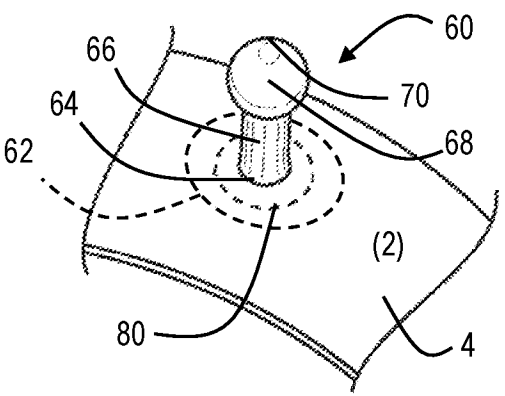
FIG. 5A illustrates a perspective view of a fastening device pin mounted on the attachment device.

FIG. 5A illustrates a partial perspective view of the fastening device pin (60) of FIGS. 1-4 mounted on the webbing matrix (2) of the attachment device (1). As described above, the fastening device pin (60) includes a thin flexible base flange (62) attached to a base perimeter portion (64) that supports a neck section (66). A head section (68) is attached to the neck section (66) and provides a spherical portion (72) at a distal end (70). The head section (68) has an exterior diameter larger than an exterior diameter of the neck section (66). The spherical portion (72) is configured to be captured within a channel of a retaining device (4000) described in FIG. 7C.

Figure 5B:
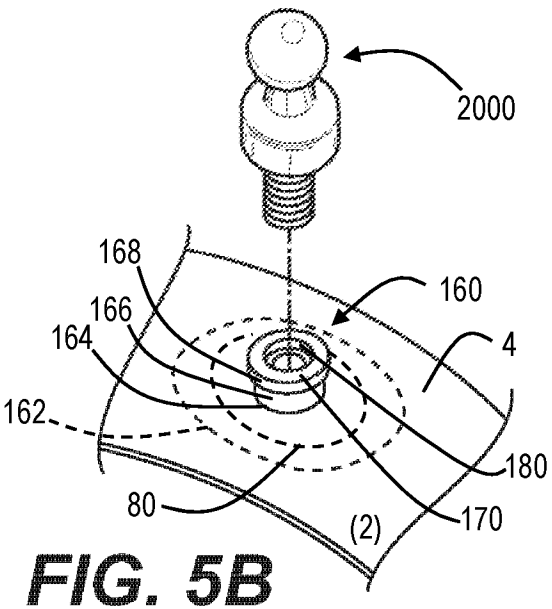
FIG. 5B illustrates a perspective view of a fastening device tab mounted on the attachment device.

FIG. 5B illustrates a partial perspective view of a fastening device tab (160) mounted on the webbing matrix (2) of the attachment device (1). The fastening device tab (160) includes a thin flexible base flange (162) connected to a base perimeter portion (164) that supports a neck section (166). A head section (168) is attached to the neck section (166) wherein the head section (168) has an exterior diameter larger than the exterior diameter of the neck section (166). The fastening device tab (160) includes an interior threading (180) beginning at a distal end (170) and passing through a substantial portion of the fastening device tab (160). The interior threading (180) is continued to allow a threaded connection to an external connection pin (2000) within the fastening device tab (160).

Figure 5C:
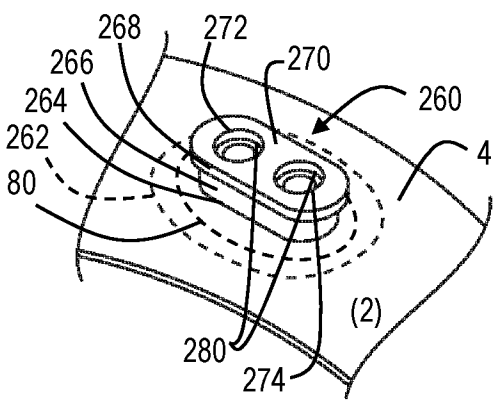
FIG. 5C illustrates a perspective view of a fastening device oblong tab mounted on the attachment device.

FIG. 5C illustrates a partial perspective view of a fastening device oblong tab (260) mounted on the webbing matrix (2) of the attachment device (1). The fastening device oblong tab (260) includes a thin flexible base flange (262) connected to a base perimeter portion (264) that supports a neck section (266). A head section (268) is attached to the neck section (266) wherein the head section (268) has an overall larger exterior diameter than the overall exterior diameter of the neck section (266). The fastening device oblong tab (260) includes a first hole (272) and a second hole (274) both containing interior threaded portions (280) beginning at each distal end (270) and passing through a substantial portion of the fastening device oblong tab (260). The interior threading (280) allows for a threaded connection to an external connection pin (2000), as described above, within the fastening device oblong tab (260) to either the first hole (272) and/or the second hole (274).

Figure 5D:
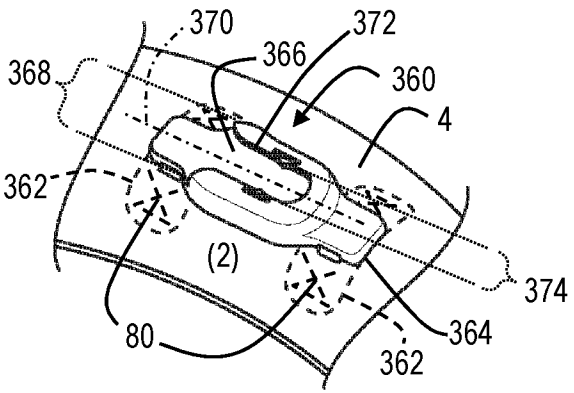
FIG. 5D illustrates a perspective view of a fastening device clip mounted on the attachment device.

FIG. 5D illustrates a partial perspective view of a fastening device clip (360) mounted on the webbing matrix (2) of the attachment device (1). The fastening device clip (360) includes thin flexible base flanges (362) connected to a base perimeter portion (364). A receiving channel portion (366) having a first width (368) runs along a portion of a longitudinal axis (370) of the fastening device clip (360). The receiving channel portion (366) may be configured to receive the head sections of either the fastening device tab (160) or the fastening device oblong tab (260), described above. The fastening device clip (360) further includes a retaining slot (372) having a second width (374) narrower than the first width (368), and similarly running along a portion of the longitudinal access (370) of the fastening device clip (360). The retaining slot (372) is configured to interface with the neck sections of the fastening device tab (160) and the fastening device oblong tab (260).

Figure 5E:
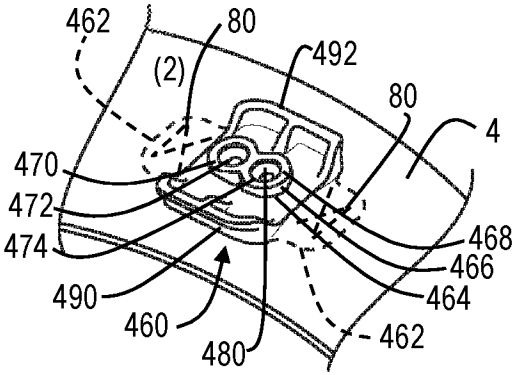
FIG. 5E illustrates a perspective view of a fastening device multi-feature tab mounted on the attachment device.

FIG. 5E illustrates a partial perspective view of a fastening device multi-feature tab (460) mounted on the webbing matrix (2) of the attachment device (1). The fastening device multi-feature tab (460) includes a thin flexible base flange (462) connected to a base portion (464) that supports a central neck section (466) having a head section (468) thereon, wherein the head section (468) has an overall larger exterior diameter than the overall exterior diameter of the neck section (466). The head section includes a first hole (472) and on a second hole (474) with each hole containing an interior threading portion (480) in a similar manner to the fastening device oblong tab (260). The interior threading (480) allows for a threaded connection to the external connection pin (2000), as described above. The fastening device multi-feature tab (460) further includes a first retaining edge projection (492) and on a second oppositely disposed retaining edge projection (494) that are configured to be connected to an external retaining device, (not shown).

Figure 6B:
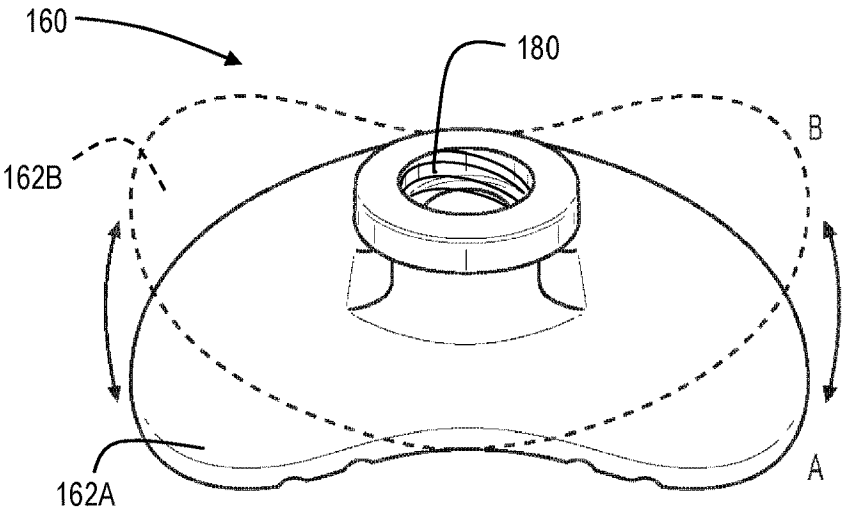
FIG. 6B illustrates a perspective view of the fastening device tab of FIG. 5B in a flexed state.
Figure 6A:
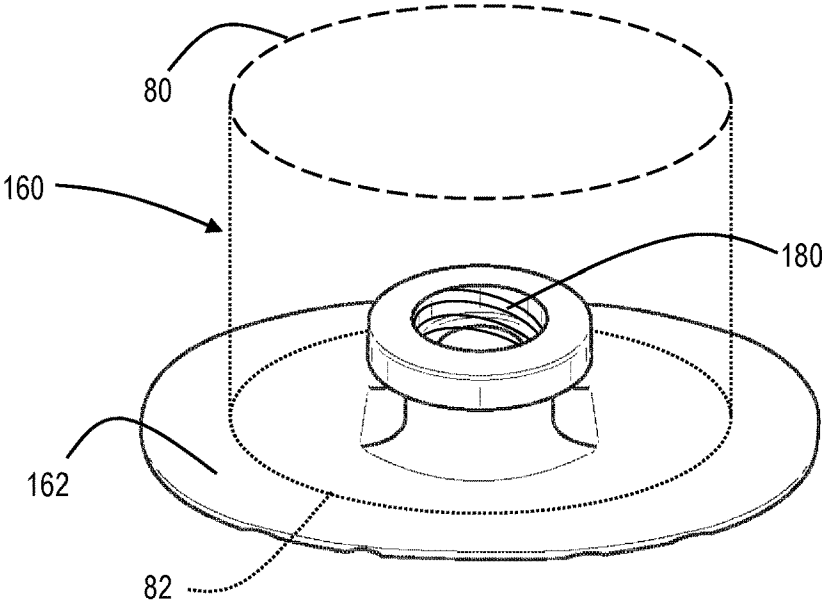
FIG. 6A illustrates a perspective view of the fastening device tab of FIG. 5B in a non-flexed state.

FIG. 6A illustrates a perspective view of the fastening device tab (160) of FIG. 5B in a non-flexed state where the thin flexible base flange (162) is in a relaxed and substantially planar orientation. Note the stitching (80) and the corresponding stitching perimeter outline (82) where the thin flexible base flange (162) receives the stitching (80) when attached to the webbing matrix (2) and/or the first hook or loop material (30). FIG. 6B illustrates a corresponding perspective view of the fastening device tab (160) of FIG. 5B in a flexed state where the thin flexible base flange (162) is flexed in a downward (162A) state of position "A", and an upward state (162B) of position "B". The flexibility of the base flange in each of the embodiments of the fastening devices disclosed herein, allows the attachment device (1) to flexibly adapt to the surface contour of an item the attachment device is attached to. FIGS. 6A and 6B generally represent the functioning of each thin flexible base flange of the embodiments of FIGS. 5A to 5E. Furthermore, the stitching (80), when attached to the thin flexible base flange, can easily conform to the surface geometry of any device the attachment device (1) is secured to.

Figure 7B:
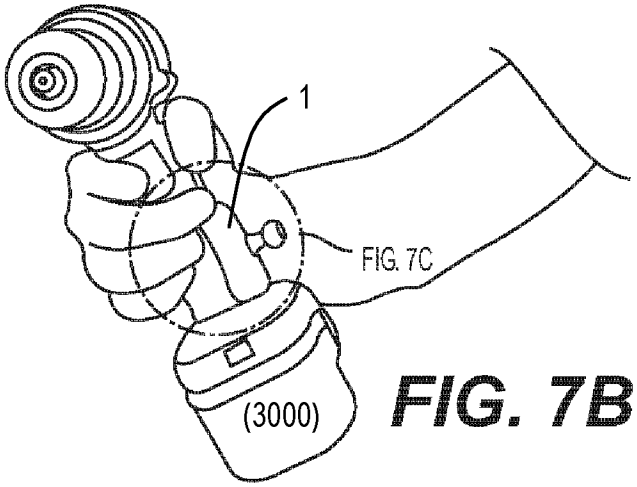
FIG. 7B illustrates a perspective view of the first embodiment of the attachment device connected to the portable hand tool.
Figure 7A:
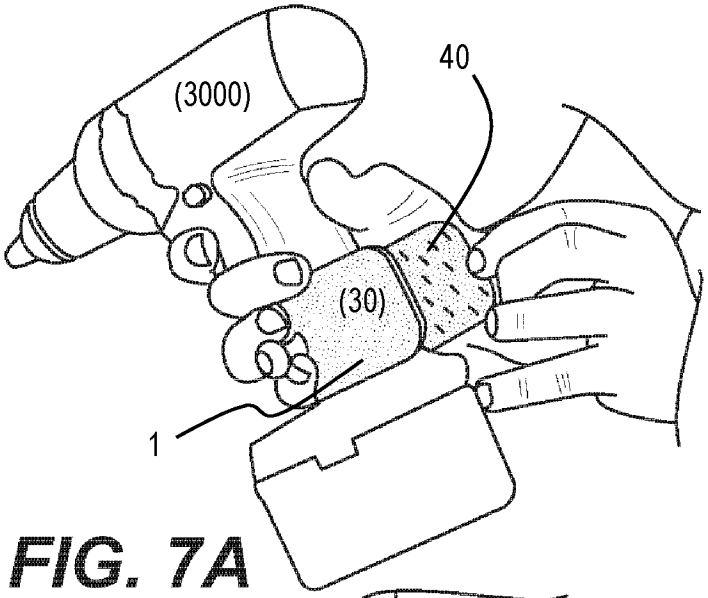
FIG. 7A illustrates a perspective view of the first embodiment of the attachment device being connected to a portable hand tool.

FIG. 7A illustrates a perspective view of the first embodiment of the attachment device (1) being connected to a portable hand tool (3000). FIG. 7A illustrates a user securing the second side (6) of the first end (8) of the attachment device (1) to the first side (10) of the second end (10). FIG. 7B illustrates a perspective view of the first embodiment of an attachment device connected to a portable hand tool where the fastening device pin (60) projects from the side of the portable hand tool (3000).

Figure 7C:
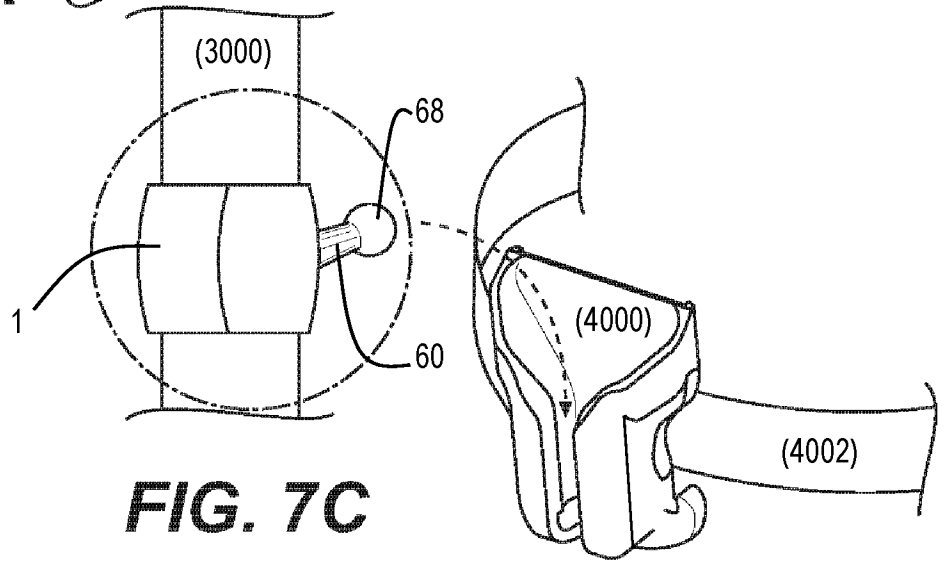
FIG. 7C illustrates a perspective view of the first embodiment of the attachment device where a fastening device pin is being coupled to a holster device.

FIG. 7C illustrates a partial perspective view of the first embodiment of an attachment device where a fastening device pin (60) mounted on the portable hand tool (3000) by means of the attachment device (1) may be coupled to holster device (4000) attached to a belt (4002). In this illustration, the head section (68) of the pin (60) is configured to slide into a corresponding locking channel of a holster (4000).

Figure 8:
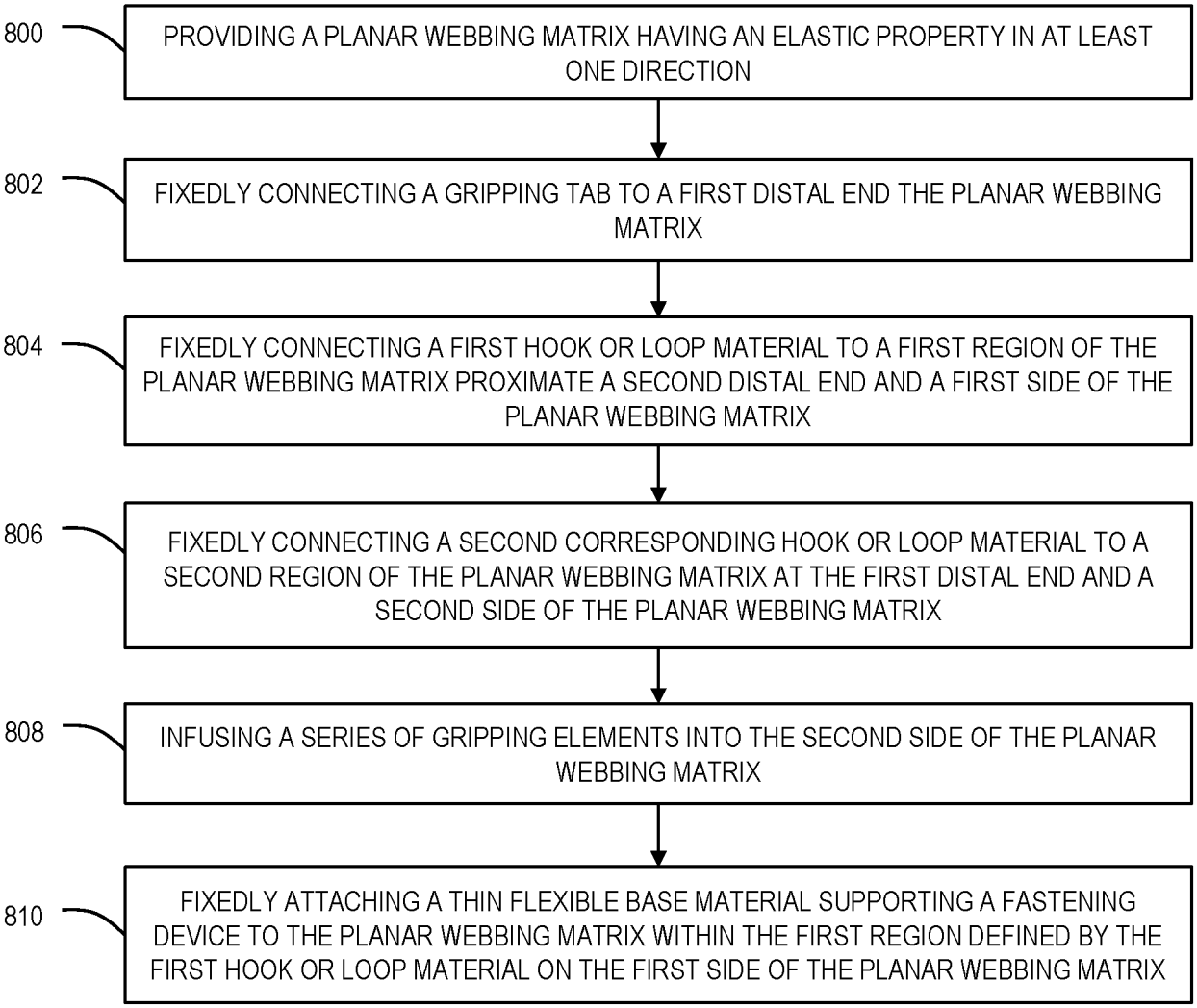
FIG. 8 illustrates a logic flow chart of a method of fabricating the fastening device.

FIG. 8 illustrates a logic flowchart of a method of fabricating the fastening device (1). The method includes providing (800) a webbing matrix having an elastic property in at least one direction, fixedly connecting (802) a gripping tab to a first distal end the webbing matrix and fixedly connecting (804) a first hook or loop material proximate a second distal end and on a first side of the webbing matrix. The method further includes fixedly connecting (806) a second corresponding hook or loop material to a second region of the webbing matrix at the first distal end and on a second side of the webbing matrix, and infusing (808) a series of gripping elements into the second side of the webbing matrix. The method further includes fixedly attaching (810) a thin flexible base material supporting a fastening device to the webbing matrix on the first side of the webbing matrix.

Further elements fabricating the fastening device may include infusing an array of uniformly spaced elements disposed across a portion of the length and the width of webbing matrix opposite the first hook or loop material, and/or infusing a pattern of lines disposed across a portion of the length and the width of webbing matrix opposite the first hook or loop material. The series of gripping elements may be disposed into the second side of the webbing matrix opposite the first hook or loop material.

Further elements fabricating the fastening device may include fixedly attaching the thin flexible base material supporting the fastening device to the webbing matrix by stitching the thin flexible base material to the webbing matrix. Additionally, the fastening device is provided with means configured to provide attachment to a corresponding retaining device.

Thus, the above disclosure provides new and improved devices and method of fabricating an attachment device. While the invention has been shown and described with respect to the above described embodiments, it is not thus limited. Numerous modifications, changes and enhancements will now be apparent to the reader.

What is claimed is:

1. A device comprising:

a webbing matrix having an elastic property in at least one direction;

a gripping member fixedly connected to a first distal end of the webbing matrix;

a first hook or loop material disposed proximate a second distal end and on a first side of the webbing matrix;

a second corresponding hook or loop material disposed proximate the first distal end and on a second side of the webbing matrix;

a series of elastomeric gripping elements disposed on the second side of the webbing matrix; and a fastening pin disposed on and projecting from the first side of the webbing matrix, the fastening pin further comprising a thin flexible base material surrounding a perimeter of the fastening pin at a first distal end of the fastening pin, the thin flexible base material is fixedly connected to the webbing matrix and configured to bend in an arcuate manner with corresponding movement of the webbing matrix, a neck section disposed proximate to the first distal end of the fastening pin and extending above the first side of the webbing matrix, and a substantially spherical shaped head section disposed on a second distal end of the fastening pin opposite the thin flexible base material.

2. A device comprising:

a webbing matrix;

a gripping member fixedly connected to a first distal end of the webbing matrix;

a first hook or loop material disposed proximate a second distal end and on a first side of the webbing matrix;

a second corresponding hook or loop material disposed proximate the first distal end and on a second side of the webbing matrix;

a series of elastomeric gripping elements disposed on the second side of the webbing matrix; and a fastening pin disposed on the first side of the webbing matrix, the fastening further comprising a thin flexible base material surrounding a perimeter of the fastening pin at a first distal end of the fastening pin, the thin flexible base material is fixedly connected to the webbing matrix, a neck section disposed proximate to the first distal end of the fastening pin and extending above the first side of the webbing matrix, and a substantially spherical shaped head section disposed on a second distal end of the fastening pin opposite the thin flexible base material.

3. The device according to claim 2, wherein the series of elastomeric gripping elements being disposed on the second side of the webbing matrix and opposite the first hook or loop material on the first side of the webbing matrix.

4. The device according to claim 3, wherein the series of elastomeric gripping elements comprise an array of elements, each element of the array uniformly spaced from adjacent elements and disposed across the length and width of webbing matrix on the second side of the webbing matrix opposite the first hook or loop material on the first side of the webbing matrix.

5. The device according to claim 2, wherein the thin flexible base material surrounding the perimeter of the fastening pin at the first distal end of the fastening pin is configured to bend in an arcuate manner with corresponding movement of the webbing matrix.

6. The device according to claim 2, wherein the webbing matrix has elastic qualities only in a unidirectional orientation.

7. The device according to claim 2, wherein the substantially spherical shaped head section of the fastening pin is configured to be retained within a corresponding retaining device.

8. The device according to claim 1, wherein the series of elastomeric gripping elements being disposed on the second side of the webbing matrix are disposed opposite the first hook or loop material on the first side of the webbing matrix.

9. The device according to claim 8, wherein the series of elastomeric gripping elements comprise an array of elastomeric elements, each element of the array uniformly spaced from adjacent elements and disposed across the length and width of webbing matrix on the second side of the webbing matrix opposite the first hook or loop material on the first side of the webbing matrix.

10. The device according to claim 1, wherein the webbing matrix has elastic qualities only in a unidirectional orientation.

11. The device according to claim 1, wherein the substantially spherical shaped head section has a diameter greater than a cross sectional diameter of the neck section.

12. The device according to claim 11, wherein the substantially spherical shaped head section is disposed above the webbing matrix, supported by the neck section, at least a distance equal to a diameter of the substantially spherical shaped head section.

13. The device according to claim 1, wherein the neck section and substantially spherical shaped head section are removably attached to the thin flexible base material.

14. The device according to claim 4, wherein the array of elastomeric elements comprise a uniformly spaced series of raised silicone circular shapes.

15. The device according to claim 4, wherein the array of elastomeric elements comprise a first uniformly spaced series of raised silicone linear rows.

16. The device according to claim 15, wherein the array of elastomeric elements further comprise a second uniformly spaced series of raised silicone linear rows intersecting a portion of the first uniformly spaced series of raised silicone linear rows.

17. The device according to claim 2, wherein the substantially spherical shaped head section has a diameter greater than a cross sectional diameter of the neck section.

18. The device according to claim 17, wherein the substantially spherical shaped head section is disposed above the webbing matrix, supported by the neck section, at least a distance equal to a diameter of the substantially spherical shaped head section.

19. The device according to claim 2, wherein the neck section and substantially spherical shaped head section are removably attached to the thin flexible base material.

20. The device according to claim 19, wherein the thin flexible base material comprises an internally threaded portion configured receive a corresponding externally threaded portion on the neck section.

21. A device comprising:

a webbing matrix having an elastic property in at least one direction;

a gripping member fixedly connected to a first distal end the webbing matrix;

a first hook or loop material disposed proximate a second distal end and on a first side of the webbing matrix;

a second corresponding hook or loop material disposed proximate the first distal end and on a second side of the webbing matrix;

a series of elastomeric gripping elements disposed on the second side of the webbing matrix; and a fastening device disposed on the first side of the webbing matrix, the fastening device further comprising a thin flexible base material surrounding a portion of a perimeter of the fastening device, the thin flexible base material fixedly connected to the webbing matrix, a receiving channel portion having a first width along a longitudinal axis of the fastening device, and a retaining slot having a second width along the longitudinal axis of the fastening device, the second width being less than the first width.

* * * * *